US005199364A

United States Patent [19]

Conte et al.

[11] Patent Number: 5,199,364

[45] Date of Patent: Apr. 6, 1993

[54] SEWING MACHINE HAVING TWO BORDERING GUIDES MOVABLE VERTICALLY AND HORIZONTALLY RESPECTIVELY, FOR APPLYING RIBBON LIKE TRIMMINGS TO A WORK PIECE

[75] Inventors: Robert F. I. Conte, Buccinasco; Angiolicchio Raffaele, Cesano Boscone, both of Italy

[73] Assignee: Rimoldi, S.R.L., Milan, Italy

[21] Appl. No.: 499,807

[22] Filed: Mar. 27, 1990

[30] Foreign Application Priority Data

Oct. 20, 1989 [IT] Italy ..... 22095 A/89

[51] Int. Cl.[5] ..... D05B 35/06; D05B 35/08; D05B 35/10

[52] U.S. Cl. ..... 112/152; 112/147; 112/137

[58] Field of Search ..... 112/10, 11, 12, 18, 112/20, 27, 62, 63, 105, 121.12, 121.15, 137, 152, 261.2, 265.2, 147, 303

[56] References Cited

U.S. PATENT DOCUMENTS

| | | | |
|---|---|---|---|
| 1,015,967 | 1/1912 | Laubscher | 112/147 |
| 1,024,316 | 4/1912 | De Voe | 112/147 |
| 1,201,423 | 10/1916 | Almond | 112/152 |
| 2,506,325 | 5/1950 | Ackerman | 112/152 X |
| 2,612,855 | 10/1952 | Sailer | 112/147 |
| 2,761,401 | 9/1956 | Dolney | 112/152 |
| 3,548,767 | 12/1970 | Williams | 112/152 |
| 4,744,317 | 5/1988 | Cullen | 112/27 X |

FOREIGN PATENT DOCUMENTS

| | | | |
|---|---|---|---|
| 1121913 | 1/1962 | Fed. Rep. of Germany | 112/137 |

*Primary Examiner*—Werner H. Schroeder
*Assistant Examiner*—Ismael Izaguirre
*Attorney, Agent, or Firm*—Laff, Whitesel, Conte & Saret

[57] ABSTRACT

A sewing machine having two bordering guides (11, 16) that are used to apply two different ribbon-like trimmings to a workpiece. The first bordering guide (11) is mounted on a machine bed (2) and oscillatable about a vertical axis spaced apart sideways from the working position located in front of a machine presser foot. The second bordering guide (16) is mounted on the machine bed (2) and oscillatable about a horizontal axis arranged at right angles to a workpiece advancing direction and below the working position. Each of the first and second bordering guides is moved from a rest position to a working position located before the presser foot so that they reach the working position alternately with the other while the stitching operation is being carried out.

9 Claims, 2 Drawing Sheets

SEWING MACHINE HAVING TWO BORDERING GUIDES MOVABLE VERTICALLY AND HORIZONTALLY RESPECTIVELY, FOR APPLYING RIBBON LIKE TRIMMINGS TO A WORK PIECE

BACKGROUND OF THE INVENTION

1. Field of the Invention

The present invention relates to a sewing machine adapted to apply ribbon-like trimmings to a workpiece, of the type comprising: a bed at the top of which a work table is defined, along which table the workpiece to be fed is advanced; a head held in cantilevered fashion above the work table; a presser foot oscillatably connected to the head and spring pushed towards the work table for pressing the workpiece against the work table itself; sewing means operating through the work table in the region of the presser foot in order to sew the workpiece.

2. Known Art

It is known that when workpieces are sewn together in order to make garments or other articles, provision is often made for operating steps in which a piece of ribbon-like trimmings must be applied along the edge of the workpiece being worked. These operating steps are currently carried out by specific sewing machines provided with a bordering guide fastened to the machine bed and suitably conformed so that the ribbon-like trimmings, travelling along the bordering guide, can be folded over lengthwise leaving then the bordering guide when they reach the outlet end thereof which is located before the presser foot. At said outlet end, the folded ribbon-like trimmings are then engaged on either side of the workpiece edge, so that they can be fastened thereto when the stitching is carried out.

When the stitching is completed the piece of trimmings is cut downstream of the presser foot so that an end portion thereof is clamped under the presser foot, which will allow an easy engagement of said piece of trimmings to the next workpiece.

While they can perfectly perform the functions, sewing machines of the above type have some drawbacks as regards versatility and practical use.

In fact the fixed positioning of the bordering guide having its outlet end just before the presser foot involves some difficulties in carrying out sewings when the application of ribbon-like trimmings is not involved. In addition, at the present state of the art important problems arise when it is necessary to carry out the sewing of two different pieces of trimmings on a workpiece with one and the same machine. In this connection it is to be pointed out first of all that two different pieces of trimming cannot be applied with the same machine if said pieces are very different in width. In fact the shape and size features of the bordering guide are strictly related to the width of the piece of trimming to be applied.

In addition, when the piece of trimming to be applied to the workpiece need to be replaced by a different one, it is necessary to stop the working so as to take off the previously used trimming from the bordering guide and put the new one thereinto. It will be understood that when mass production is involved, the plurality of interruptions in working in order to change the pieces of trimming brings about important idle times in production.

SUMMARY OF THE INVENTION

The main object of the present invention is substantially to solve the problems of the known art, by providing a sewing machine capable of carrying out the sewing of at least two different types of ribbon-like trimmings without involving the above described drawbacks.

The foregoing and further objects which will become more apparent in the course of the following description, are substantially attained by a sewing machine adapted to apply ribbon-like trimmings to a workpiece, comprising: one bordering guide rotatably connected to the machine bed and rotating about a substantially vertical axis, one outlet end of which is so arranged that it slidably engages one ribbon-like trimming folding it over lengthwise and which is movable from a rest position in which it is spaced apart sideways from the work table to a working position in which its outlet end is located on the work table and in front of the presser foot; a second bordering guide oscillatably connected to the machine bed and swinging about a substantially horizontal axis at right angles to the feed direction of the workpiece on the work table, said second bordering guide having one outlet end designed to slidably engage a second ribbon-like trimming and fold it over lengthwise, and being movable from a rest position in which it is overturned before the bed and located to a lower position with respect to the work table to a use position in which its outlet end is disposed on the work table and in front of the presser foot.

BRIEF DESCRIPTION OF THE DRAWINGS

Further features and advantages will be best understood from the detailed description of a preferred embodiment of a cylinder bed sewing machine arranged to apply ribbon-like trimmings to a workpiece, in accordance with the present invention, given hereinafter by way of non-limiting example with reference to the accompanying drawings, in which.

DESCRIPTION OF THE PREFERRED EMBODIMENT

Figure 1:
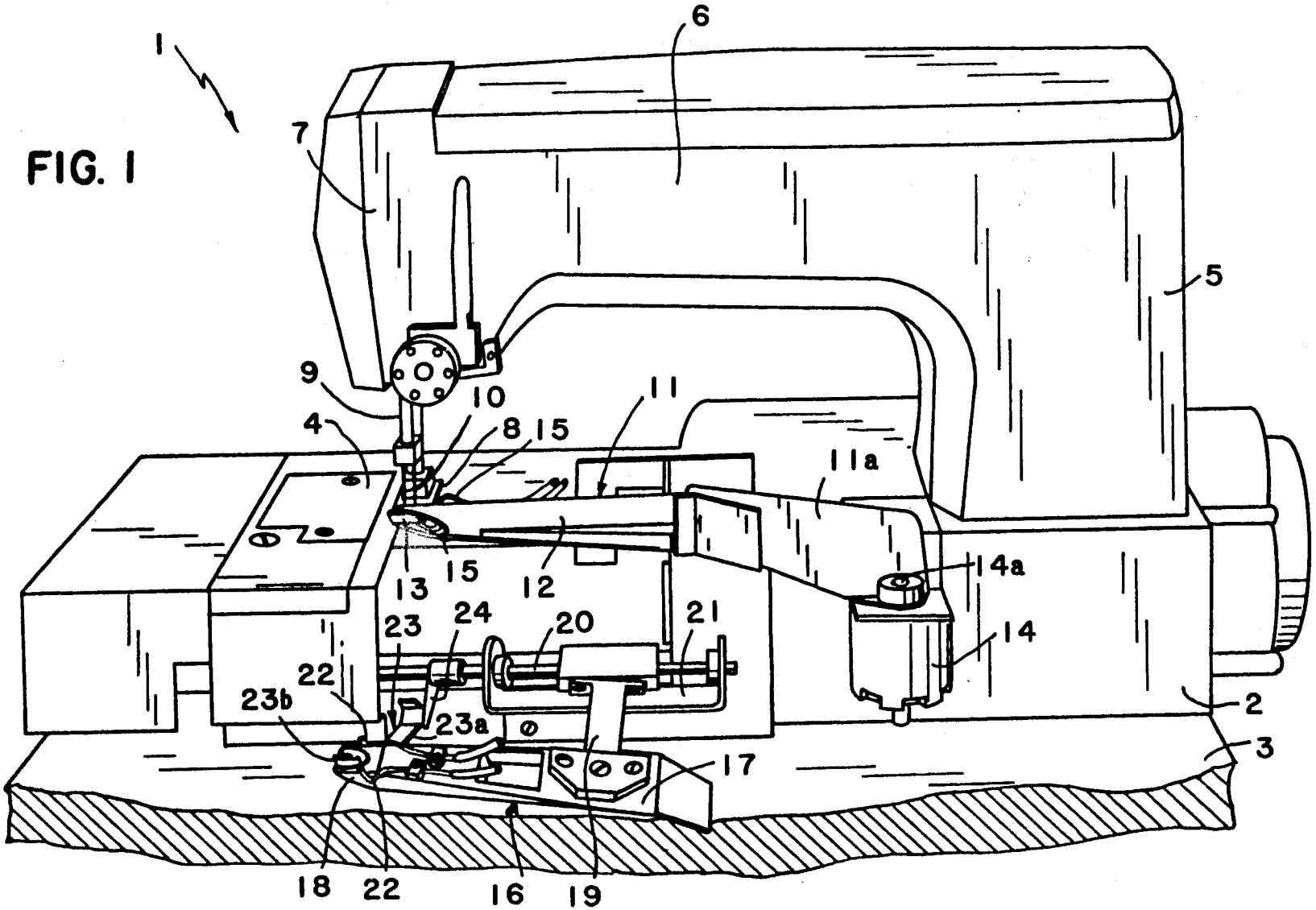
FIG. 1 is a perspective front view of the sewing machine of the invention having one bordering guide in a working position and a second bordering guide in a rest position.

Referring to the drawings, a sewing machine arranged to apply ribbon-like trimmings to a workpiece in accordance with the present invention has been generally identified by reference numeral 1.

The sewing machine 1 conventionally comprises a bed 2 mounted on a stand 3 and defining a horizontal work table 4 at the top, along which table the workpiece (not shown) is fed. A standard 5 stands upright on one side of the bed 2, and extending horizontally from the top of said standard is an arm 6 supporting in cantilevered fashion a head 7 disposed above the work table 4. Oscillatably linked to the head 7 is a presser foot 8 spring pushed towards the work table 4 so as to press the workpiece against the latter. Feed dogs (not shown as known per se) conventionally operate under the presser foot 8 and they cause the workpiece to move forward during the sewing.

Also operatively housed in the head 7 is a needle bar 9 carrying one or more needles 10 reciprocating through the presser foot 8 and the work table 4. Needles 10 cooperate with other sewing members housed in the bed 2 in order to form stitchings on the workpiece in a manner known per se.

The sewing machine 1 also comprises one bordering guide 11 designed to slidably engage one piece of ribbon-like trimming, not shown, and feed it under the presser foot 8 while stitching is being carried out. To this end the first bordering guide 11, known per se as regards its structure, essentially comprises a tubular body 12 with a section converging towards its outlet end 13 which is shaped so as to slidable engage the piece of trimming and fold it over lengthwise as it comes out of the bordering guide.

Figure 2:
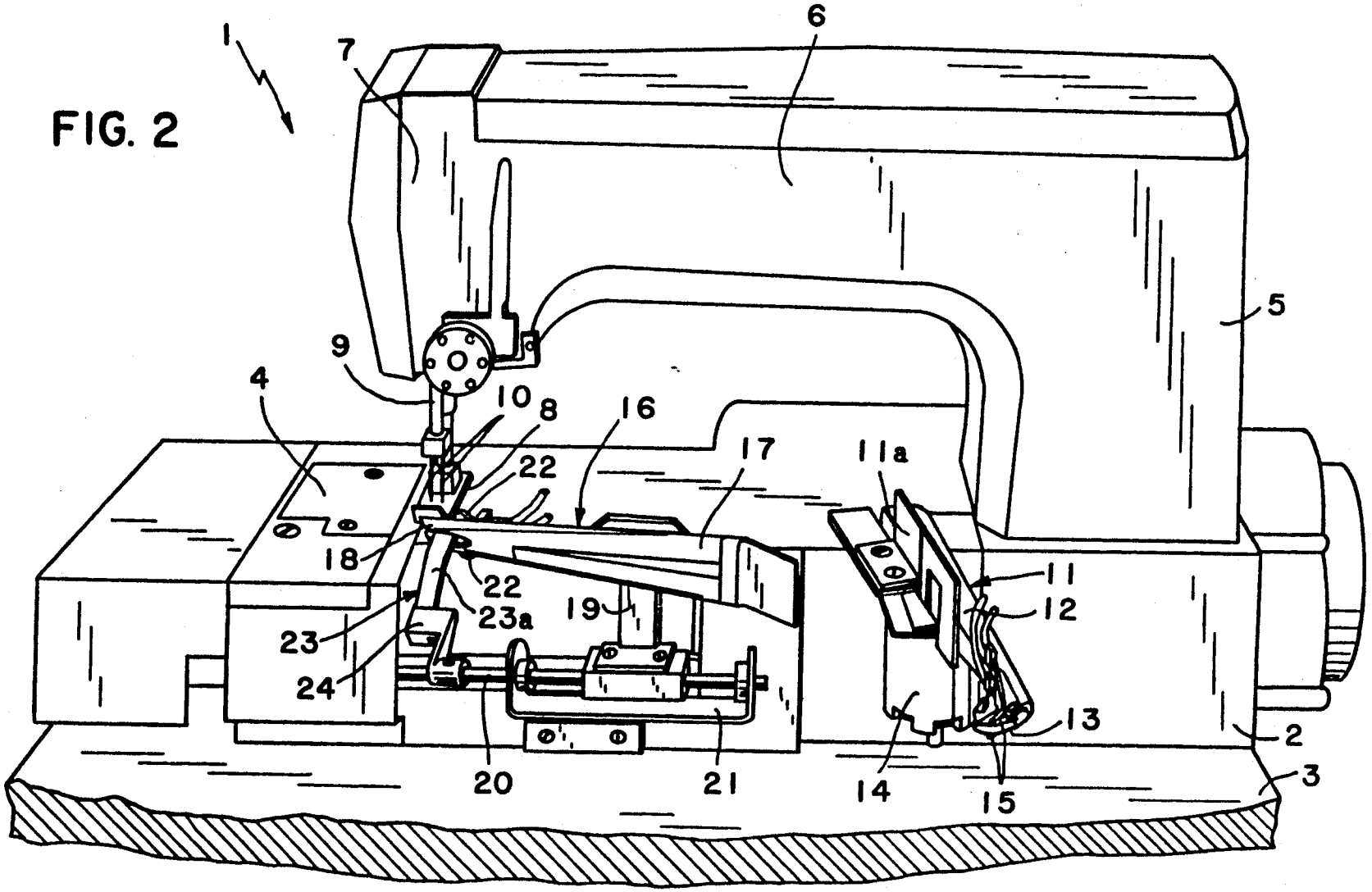
FIG. 2 is a perspective front view showing the sewing machine with the second bordering guide in a working position and the first bordering guide in a rest position.

In an original manner, the first bordering guide 11 is oscillatably connected to the bed 2, swinging about a substantially vertical axis. In greater detail, in the embodiment shown the first bordering guide 11 is mounted on a support element 11*a* in turn connected to a pin 14*a* being part of a fluid-operated rotatory actuator 14 fastened to the bed 2 and disposed according to a substantially vertical axis. The first bordering guide 11 is movable, upon the action of the rotatory actuator 14, from a rest position in which, as shown in FIG. 2, it is spaced apart sideways from the work table 2 to a working position in which, as shown in FIG. 1, it has its outlet end 13 disposed on the work table 4 and before the presser foot 8.

Also associated with the first bordering guide 11 is one or more blowing nozzles 15 acting in the region of the outlet end 13 and substantially facing the presser foot 8 when the guide itself is in its working position. Two first blowing nozzles 15 located on the opposite sides respectively of the outlet end 13 are preferably provided. The blowing nozzles 15 are supplied with compressed air so that during the passage of the bordering guide 11 from the rest position to the working position, the end portion of the ribbon-like trimming projecting forward from the outlet end 13 takes a substantially horizontal orientation so that it is automatically engaged under the presser foot 8 when the bordering guide reaches it working position.

Still in accordance with the invention, also associated with the sewing machine 1 is a second bordering guide 16, designed to feed a second piece of trimming, not shown, under the presser foot 8 while a stitching is being carried out. In the same manner as described with reference to the first bordering guide 11, the second bordering guide 16 consists of a tubular body 17 designed to slidably engage the second piece of trimming and becoming gradually narrower towards its outlet end 18 which is shaped so as to fold over the piece of trimming lengthwise as it comes out of the bordering guide.

Advantageously, the second bordering guide 16 is oscillatably connected to the bed 2, swinging about a substantially horizontal axis at right angles to the forward movement of the workpiece on the work table 4. To this end, the second bordering guide 16 is fastened to a support element 19 integral to a drive shaft 20 rotatably supported by a bracket 21 secured to the bed 2. The drive shaft 20 is driven in rotation about its own axis, for example by means of a second fluid-operated rotatory actuator housed in the bed 2 and not shown as known per se and conventional. The rotation of shaft 20 causes the second bordering guide 16 to move from a rest position in which, as shown in FIG. 1, it is overturned in front of the bed 2, and located to a lower position with respect to the work table 4, to a working position in which, as shown in FIG. 2, it has its outlet end 18 on the work table 4 and in front of the presser foot 8.

The second bordering guide 16 as well, is preferably provided with at least a second blowing nozzle 22 disposed close to the outlet end 18 and substantially facing the presser foot 8 when the bordering guide is in its working position. In the embodiment shown two second blowing nozzles 22 are provided, disposed on either side of the outlet end 18 and adapted to be supplied with compressed air when the second bordering guide 16 moves from the rest position to the working position in order to ensure the insertion of the second piece of trimming under the presser foot 8.

Provision is also made for an auxiliary feed guide 23 to be preferably associated with at least one of the bordering guides 11, 16, in the embodiment shown to the second bordering guide 16; said auxiliary guide 23 is fixed relative to the bordering guide 16 and is designed to feed an auxiliary ribbon-like trimming or insert (not shown), such as a rubber tape or a reinforcing tape, within the folded ribbon-like trimming coming out of the bordering guide itself. To this end the auxiliary guide 23 is mounted on a support 24 integral to the drive shaft 20 and has a flattened tubular section body 23*a* designed to slidably engage the auxiliary trimming. The body 23*a* terminates in an outlet end 23*b* which is inserted in the outlet end 18 of the second bordering guide 16.

Operation of the sewing machine according to the invention mainly described as regards structure, is as follows.

If both the first bordering guide 11 and the second bordering guide 16 are kept in their respective rest positions, the sewing machine 1 lends itself to be used for carrying out mere stitching works without the introduction of ribbon-like trimmings.

When in the course of working one ribbon-like trimming needs to be applied to the workpiece, the first rotatory actuator 14 is operated so that it brings the first bordering guide 11 to its working position. Simultaneously, the first blowing nozzles 15 are supplied with compressed air, so as to produce an air flow ensuring the introduction of the end portion of the first ribbon-like trimming under the presser foot 8, arranged in a raised position.

When the first bordering guide 11 has reached the working position it is possible to dispose the workpiece edge at the outlet end 13 so that the ribbon-like trimming is folded over and comes in engagement on either side of the edge itself, in order to start the sewing operation after lowering the presser foot 8.

At the end of stitching, the first ribbon-like trimming is automatically cut downstream of the presser foot 8 by cutting means known per se and conventional in a manner allowing the end portion thereof projecting from the outlet end 13 of the first bordering guide 11 to remain engaged under the presser foot itself.

Under this situation, should the trimming need to be applied to another edge of the workpiece, the operation could be easily carried out.

If, on the contrary, it is necessary to apply the second ribbon-like trimming, which may be different from the first one as regards color and/or size, the first bordering guide 11 is brought back to its rest position after raising the presser foot 8, so as to leave room for the second bordering guide 16 which, through the angular rotation of the drive shaft 20, is brought to its working position in order to enable the second trimming to be applied. The end portion of this trimming projecting from the outlet end 18 of the second bordering guide 16 is automatically disposed under the presser foot 8 by effect of the air flows produced by the blowing nozzles 22.

When the second bordering guide 16 is in its working position the workpiece is disposed so that one of its edges is at the outlet end 18 and, after lowering the presser foot 8, the sewing is started and the second ribbon-like trimming is fastened on either side of said edge.

Advantageously, the presence of the auxiliary feed guide 23 allows an auxiliary ribbon-like insert such as a rubber tape or the like to be applied, when necessary, simultaneously with the sewing of the second ribbon-like trimming. The auxiliary insert, coming out of the outlet end **23*b* of the auxiliary guide 23, can in fact be engaged inside the second folded ribbon-like trimming and therefore it comes under the presser foot 8** together with the second ribbon-like trimming and is fastened to the workpiece together with said trimming when the stitching is carried out.

In this case too the second ribbon-like trimming and the optonial auxiliary insert are cut immediately downstream of the presser foot 8 at the end of each stitching.

Obviously the second bordering guide 16 can be brought back, after raising the presser foot 8, to its rest position in order to allow other stitchings to be carried out without the addition of trimmings and/or leave room for the first bordering guide, should the first ribbon-like trimming need to be applied again.

The present invention attains the intended purposes.

The sewing machine in accordance with the invention is in fact capable of eliminating idle times in production which currently occur in the known art when one and the same machine must be used for applying ribbon-like trimmings of different sizes and/or colors.

Thanks to the possibility of bringing both bordering guides to a rest position, the present sewing machine also eliminates all difficulties present in the known art when a machine provided with a bordering guide is used to carry out normal sewings without the addition of trimmings.

Obviously modifications and variations can be made to the invention, all of them falling within the protection boundaries of the claims set out below.

What is claimed is:

1. A sewing machine having means to apply ribbon-like trimmings to a workpiece, comprising:

a work table defined along a top surface of a bed and the workpiece advanced along said work table;

a head held in cantilevered fashion above the work table;

a presser foot oscillatably connected to the head for pressing the workpiece against the work table;

sewing means operating through the work table in a region of the presser foot in order to sew the workpiece;

a first bordering guide rotatably connected to the bed and rotating about a substantially vertical axis, said first bordering guide having a first outlet end for slidably engage a ribbon-like trimming that folds over lengthwise and moves from a rest position where said first bordering guide is spaced apart sideways from the work table to a working position where the first outlet end is located on the work table and in front of the presser foot;

a second bordering guide oscillatably connected to the machine bed and oscillatable about a substantially horizontal axis at right angles to a feed direction of the workpiece on the work table, said second bordering guide having an outlet end to slidably engage a second ribbon-like trimming that folds over lengthwise, and movable from a rest position where the second bordering guide is in a lower position with respect to the work table to a working position where an outlet end of said second bordering guide is disposed on the work table in front of the presser foot and;

said first bordering guide is fastened to a support element operatively connected to a fluid-operated rotary actuator secured to the sewing machine bed and disposed relative to a substantially vertical axis.

2. A sewing machine having means to apply ribbon-like trimmings to a workpiece, comprising:

a work table defined along a top surface of a bed and the workpiece advanced along said work table;

a head held in cantilevered fashion above the work table;

a presser foot oscillatably connected to the pressing the workpiece against the work table;

sewing means operating through the work table in a region of the presser foot in order to sew the workpiece;

a first bordering guide rotatably connected to the bed and rotating about a substantially vertical axis, said first bordering guide having a first outlet end for slidably engage a ribbon-like trimming that folds over lengthwise and moves from a rest position where said first bordering guide is spaced apart sideways from the work table to a working position where the first outlet end is located on the work table and in front of the presser foot;

a second bordering guide oscillatably connected to the machine bed and oscillatable about a substantially horizontal axis at right angles to a feed direction of the workpiece on the work table, said second bordering guide having an outlet end to slidably engage a second ribbon-like trimming that folds over lengthwise, and movable from a rest position where the second bordering guide is in a lower position with respect to the work table to a working position where an outlet end of said second bordering guide is disposed on the work table in front of the presser foot and; said second bordering guide is fastened to a support element integral to a drive shaft rotatably engaged to the machine bed and driven in angular rotation about a drive shaft axis so as to bring said second bordering guide from said rest position to said working position and conversely.

3. A sewing machine having means to apply ribbon-like trimmings to a workpiece, comprising:

a work table defined along a top surface of a bed and the workpiece advanced along said work table;

a head held in cantilevered fashion above the work table;

a presser foot oscillatably connected to the head for pressing the workpiece against the work table;

sewing means operating through the work table in a region of the presser foot in order to sew the workpiece;

a first bordering guide rotatably connected to the bed and rotating about a substantially vertical axis, said first bordering guide having a first outlet end for slidably engage a ribbon-like trimming that folds over lengthwise and moves from a rest position where said first bordering guide is spaced apart sideways from the work table to a working position where the first outlet end is located on the work table and in front of the presser foot;

a second bordering guide oscillatably connected to the machine bed and oscillatable about a substantially horizontal axis at right angles to a feed direction of the workpiece on the work table, said second bordering guide having an outlet end to slidably engage a second ribbon-like trimming that folds over lengthwise, and movable from a rest position where the second bordering guide is in a lower position with respect to the work table to a working position where an outlet end of said second bordering guide is disposed on the work table in front of the presser foot and;

said bordering guides are each associated with at least a blowing nozzle disposed in close proximity to each outlet end of the bordering guides and facing the presser foot when the corresponding bordering guide is in the working position.

4. A sewing machine according to claim 3, wherein two blowing nozzles are associated with each bordering guide and respectively disposed on a side of the outlet end of the bordering guide.

5. A sewing machine having means to apply ribbon-like trimmings to a workpiece, comprising:

a work table defined along a top surface of a bed and the workpiece advanced along said work table;

a head held in cantilevered fashion above the work table;

a presser foot oscillatably connected to the head for pressing the workpiece against the work table;

sewing means operating through the work table in a region of the presser foot in order to sew the workpiece;

a first bordering guide rotatably connected to the bed and rotating about a substantially vertical axis, said first bordering guide having a first outlet end for slidably engage a ribbon-like trimming that folds over lengthwise and moves from a rest position where said first bordering guide is spaced apart sideways from the work table to a working position where the first outlet end is located on the work table and in front of the presser foot;

a second bordering guide oscillatably connected to the machine bed and oscillatable about a substantially horizontal axis at right angles to a feed direction of the workpiece on the work table, said second bordering guide having an outlet end to slidably engage a second ribbon-like trimming that folds over lengthwise, and movable from a rest position where the second bordering guide is in a lower position with respect to the work table to a working position where an outlet end of said second bordering guide is disposed on the work table in front of the presser foot and;

an auxiliary feed guide is rigidly connected to at least one of said bordering guides, an outlet end of said auxiliary guide being introduced into the outlet end of said at least one bordering guide to engage an auxiliary ribbon-like insert within one of the ribbon-like trimmings.

6. A sewing machine for applying ribbon-like trimmings to a workpiece comprising:

a bed, a work table defined along a top surface of said bed;

a head held in cantilevered fashion above said work table;

a presser foot oscillatably connected to said heads;

a first bordering guide connected to said bed and oscillatable about a substantially vertical axis, said first bordering guide being movable from a rest position, where said first bordering guide is spaced apart sideways from said presser foot to a working position, where said first bordering guide is located in front of said presser foot;

a second bordering guide connected to said bed and oscillatable about a substantially horizontal axis at right angles to a workpiece advancing direction, said second bordering guide being movable from a rest position located below said work table to a working position located in front of said presser foot; and said first bordering guide is fastened to a support element operatively connected to a fluid-operated rotatory actuator secured to said bed and disposed relative to a substantially vertical axis.

7. A sewing machine according to claim 6, wherein said first and second bordering guides are each associated with at least a first blowing nozzle disposed in close proximity to the outlet end of said bordering guides and facing the presser foot when the corresponding bordering guide is in the working position.

8. A sewing machine according to claim 7, wherein two blowing nozzles are associated with each outlet end of said bordering guides and are respectively disposed on either side of said outlet end.

9. A sewing machine according to claim 6, wherein an auxiliary feed guide is rigidly connected to at least one of said bordering guides, said auxiliary feed guide having an outlet end introduced into the outlet end of said at least one bordering guide to engage an auxiliary ribbon-like insert within the ribbon-like trimming of said at least one bordering guide.

* * * * *

UNITED STATES PATENT AND TRADEMARK OFFICE

CERTIFICATE OF CORRECTION

PATENT NO. : 5,199,364

DATED : April 6, 1993

INVENTOR(S) : Giorgio Fieschi and Raffaele Angiolicchio

It is certified that error appears in the above-identified patent and that said Letters Patent is hereby corrected as shown below:

On the title page: Item [75] should read

-- Giorgio Fieschi, Milano; Raffaele Angiolicchio, Milano, Both of Italy --.

under Item [19] should read

-- FIESCHI, ET AL --.

Signed and Sealed this

Thirty-first Day of January, 1995

Bruce Lehman

*Attest:*

BRUCE LEHMAN

*Attesting Officer*

*Commissioner of Patents and Trademarks*